US009609695B2

(12) United States Patent
Yue et al.

(10) Patent No.: US 9,609,695 B2
(45) Date of Patent: Mar. 28, 2017

(54) HEAT-GENERATING FILM, AND HEAT-GENERATING PRODUCT COMPRISING SAME

(75) Inventors: Seonghoon Yue, Seongnam-si (KR); Yongbae Jung, Cheongju-si (KR); Won-Kook Kim, Daejeon (KR); Jong-Bum Kim, Cheongju-si (KR)

(73) Assignee: LG HAUSYS, LTD., Seoul (KR)

( * ) Notice: Subject to any disclaimer, the term of this patent is extended or adjusted under 35 U.S.C. 154(b) by 0 days.

(21) Appl. No.: 13/319,915

(22) PCT Filed: Oct. 13, 2010

(86) PCT No.: PCT/KR2010/007005
§ 371 (c)(1),
(2), (4) Date: Nov. 10, 2011

(87) PCT Pub. No.: WO2011/049317
PCT Pub. Date: Apr. 28, 2011

(65) Prior Publication Data

US 2012/0055918 A1 Mar. 8, 2012

(30) Foreign Application Priority Data

Oct. 21, 2009 (KR) ..... 10-2009-0100452

(51) Int. Cl.
*H05B 3/34* (2006.01)

(52) U.S. Cl.
CPC ..... *H05B 3/34* (2013.01); *H05B 2203/006* (2013.01); *H05B 2203/029* (2013.01)

(58) Field of Classification Search
USPC ..... 219/203, 211, 212, 522, 528, 529, 541, 219/543, 520, 537, 538, 539, 542, 544, 219/549, 552, 553
See application file for complete search history.

(56) References Cited

U.S. PATENT DOCUMENTS 6,495,809 B2 * 12/2002 Bulgajewski et al. ..... 219/548
7,049,559 B2 * 5/2006 Ishii et al. ..... 219/549
7,053,344 B1 * 5/2006 Surjan et al. ..... 219/549
(Continued)

FOREIGN PATENT DOCUMENTS

CN 1663002 A 8/2005
CN 101521963 A 9/2009
(Continued)

*Primary Examiner* — David Angwin
*Assistant Examiner* — Frederick Calvetti
(74) *Attorney, Agent, or Firm* — Nath, Goldberg & Meyer; Jerald L. Meyer

(57) ABSTRACT

The present invention relates to a heat-generating film and to a heat-generating product comprising same. The heat-generating film of the present invention can continuously and stably generate heat even at a low voltage, for example, at a voltage of 12V or lower. In addition, the heat-generating film of the present invention has excellent comfort properties, filling properties, and flexibility. Accordingly, the heat-generating film of the present invention can be applied to a variety of heat-generating products, for example to a heat-generating sheet for a vehicle or for a baby stroller, or to a variety of portable heat-generating products or the like to exhibit superior effects.

8 Claims, 6 Drawing Sheets

(56) References Cited

U.S. PATENT DOCUMENTS

| | | | | |
|---|---|---|---|---|
| 7,452,452 | B2 * | 11/2008 | Ren | B82Y 10/00 204/400 |
| 8,197,621 | B2 * | 6/2012 | Jung | 156/62.2 |
| 2006/0138123 | A1 * | 6/2006 | Ishii et al. | 219/549 |
| 2007/0193996 | A1 * | 8/2007 | Nakajima et al. | 219/209 |
| 2010/0038356 | A1 * | 2/2010 | Fukuda et al. | 219/549 |
| 2010/0038357 | A1 * | 2/2010 | Fukuda et al. | 219/553 |
| 2010/0140564 | A1 * | 6/2010 | Overbreek | C09D 11/101 252/514 |

FOREIGN PATENT DOCUMENTS

| | | | | |
|---|---|---|---|---|
| JP | S51-19046 | | | 2/1976 |
| JP | 1981013689 | A | | 2/1981 |
| JP | 1986004189 | A | | 1/1986 |
| JP | 1988167695 | U | | 11/1988 |
| JP | H6-33390 | | | 4/1994 |
| JP | H09-207723 | A | | 8/1997 |
| JP | H10159317 | A | | 6/1998 |
| JP | H11-144848 | A | | 5/1999 |
| JP | H11-329683 | A | | 11/1999 |
| JP | 2000200673 | A | | 7/2000 |
| JP | 2002-75593 | A | | 3/2002 |
| JP | 2002-334769 | A | | 11/2002 |
| JP | 2004-303683 | A | | 10/2004 |
| JP | 2005-259564 | A | | 9/2005 |
| JP | 2006-351458 | A | | 12/2006 |
| JP | 2008-153049 | A | | 7/2008 |
| JP | 2008-186789 | A | | 8/2008 |
| KR | 20-2007-000255 | U | | 3/2007 |
| WO | WO2007/102734 | | * | 9/2007 |
| WO | WO 2008/091001 | | * | 7/2008 |
| WO | WO 2008/091003 | | * | 7/2008 |
| WO | 2009116786 | A2 | | 9/2009 |

* cited by examiner (a) (b)

HEAT-GENERATING FILM, AND HEAT-GENERATING PRODUCT COMPRISING SAME

This is a National Phase Application filed under 35 U.S.C. 371as a national stage of PCT/KR2010/007005, filed Oct. 13, 2010, and claims priority benefit from Korean Application No. 10-2009-0100452, filed Oct. 21, 2009, the content of each of which is hereby incorporated by reference in its entirety.

TECHNICAL FIELD

The present disclosure relates to a heat-generating film and heat generating product comprising the same.

BACKGROUND

A planar heat-generator like a heat-generating film (or heat-generating sheet) can be applied to various uses such as a vehicle heat-generating sheet, stroller heat-generating sheet or portable heat-generating products.

A representative use to which the planar heat-generator is applied is a vehicle heat-generating sheet. In order to apply the planar heat-generator to the vehicle heat-generating sheet, the heat-generator should be capable of operating at a low voltage or low power with respect to the energy efficiency, and should have a good flexibility. Further, when the seat is occupied, the heat-generator should fit to a body curve of a sitter (hereinafter, sometimes depicted as ⌈filling property)), be easily bent 3-dimensionally, and exhibit a soft buffer action so as to feel comfort (hereinafter, sometimes depicted as ⌈comfort property)).

As the said heat-generating film or heat-generating sheet, a product wherein both sides of a wire-shape heat-generating material are wrapped with a non-woven fabric has been in use.

However, in case of the existing heat-generating product which has non-woven fabric attached to the both sides of the As shown in FIG. 2, in the heat-generating film (1) of the present invention, one or more heat-generating parts (12*a*, 12*b*, 12*c* and the like) which exist on the base sheet (11) by being patterned in a linear configuration in one direction (for example, widthwise direction of the base sheet) can be parallelly arranged separately to each other in the heat-generating layer. As shown in FIG. 2, the said heat-generating part may be formed in multiple parts in the present invention, and a single heat-generating part can be formed solely under certain circumstances. Hereinafter, the terms ⌈widthwise direction⌋ and ⌈longitudinal direction⌋ used herein are relative concepts, for example, if a direction which is parallel to any one side of the base sheet is defined as ⌈widthwise direction⌋, a direction which is perpendicular to the said ⌈widthwise direction⌋ can be defined as ⌈longitudinal direction⌋. Further, in case that the base sheet has not only a square or rectangular configuration but also a circular, elliptical, polygonal or amorphous configuration in the present invention, if the heat-generating part is formed parallel to a certain direction on the base sheet, the direction is defined as the ⌈widthwise direction⌋, and the direction which is perpendicular thereto is defined as the ⌈longitudinal direction⌋.

In the present invention, it is preferred that the heat-generating part (12*a*, 12*b*, 12*c* and the like) included in the heat-generating layer is patterned to a configuration having a prescribed rule on the base sheet in relation to low voltage driving quality. heat-generating material, there is a problem that higher output power should be provided due to the heat loss caused by insulation. Further, in the wire type product, the wire length should be elongated, and the wires of a back plate and cushion should be connected to direct current to offer higher resistance. If disconnection or shortage of the wire occurs at any part of the product having a direct current structure, product defects may be caused.

In order to complement these defects of the wire product, there is a known product which uses a carbon-coated wire as the heat-generating material. However, the carbon can't be uniformly coated on the said product, and therefore can't solve the regional heat generating problem.

Further, in case of a planar heat-generator using carbon, when it is applied to the vehicle sheet, the comfort property and filling property are not sufficient because it is not easy to bend the film and is difficult to reduce the thickness. Further, if carbon is used as the heat-generating material, large resistance change is generated by physical impacts such as continuous bending. Further, in case of a carbon material, an amount of the material should increase to convert kinetic energy of electrons to heat energy, and therefore low voltage heat-generation is not possible.

SUMMARY

The present disclosure provides a heat-generating film and heat-generating product comprising the same.

According to one embodiment of the present disclosure, provided is a heat-generating film comprising: a base sheet; a heat-generating layer which is formed on the base sheet and has one or more heat-generating parts patterned in a linear configuration; and an electrode layer comprising a first main electrode and a second electrode which are patterned on the base sheet in a linear configuration perpendicular to the heat-generating part having the linear configuration and formed at both ends of the base sheet respectively, and one or more auxiliary electrodes which are extended from the first and second main electrodes in a direction parallel with the heat-generating part.

According to another embodiment of the present disclosure, provided is a heat-generating product comprising the heat-generating film according to the present invention; and a voltage application apparatus which can apply voltage to the electrode layer of the heat-generating film.

DETAILED DESCRIPTION

The present invention relates to a heat-generating film comprising: a base sheet; a heat-generating layer which is formed on the base sheet and has one or more heat-generating parts patterned in a linear configuration; and an electrode layer comprising a first main electrode and a second electrode which are patterned on the base sheet in a linear configuration perpendicular to the heat-generating part having the linear configuration and formed at the both ends of the base sheet respectively, and one or more auxiliary electrodes which are extended from the first and second main electrodes in a direction parallel with the heat-generating part.

Hereinafter, the heat-generating film according to the present invention will be described in detail.

Figure 1:
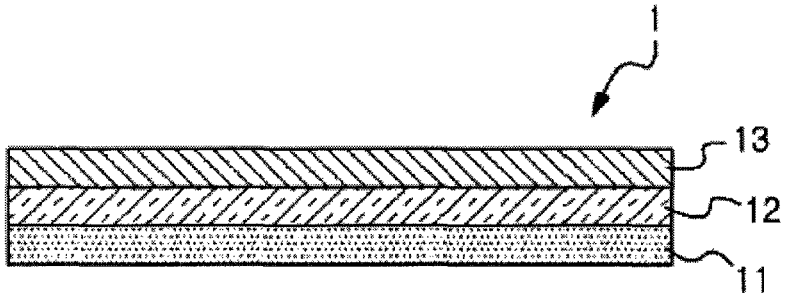
FIG. 1 is a mimetic diagram of a cross section of a heat-generating film according to one embodiment of the present invention.

As shown in the attached FIG. 1, the heat-generating film (1) of the present invention comprises the base sheet (11); a heat-generating layer (12) formed at the upper part of the said base sheet (11) and an electrode layer (13) formed at the upper part of the said heat-generating layer.

Hereinafter, the expression such as ⌈B formed at the upper (or lower) of A⌋ or ⌈B formed on A⌋, is used as a reference including a case that B is directly attached to the upper or lower part of A; a case that B is attached to the upper or lower part of A via an adhesive layer or pressure sensitive adhesive layer; and a case that one or more layers are formed at an upper or lower part of A, and B is attached to the layers directly or via the adhesive layer or pressure sensitive adhesive layer.

The kind of the base sheet (11) which can be used to prepare the heat-generating film (1) of the present invention is not particularly limited, and, for example, a general synthetic resin film known in the art can be used.

The example of the synthetic resin may be one or more laminated films selected from polyester film (ex. PET film), polyurethane film, polymethylmethacrylate film, polyvinyl chloride film, polyethylene film, polypropylene film, polyvinylidene fluoride (PVDF) film and ABS (Acrylate-Butadiene-Styrene copolymer) film.

In the present invention, in the point of view of the comfort property and filling property of the heat-generating film, the polyester film (preferably biaxially oriented polyester film (ex. BOPET (biaxially oriented polyethylene terephthalate) film)); or the laminated film of the polyester film and polyurethane film (preferably thermoplastic polyurethane film (TPU (thermoplastic polyurethane) film)) can be used as the base sheet, but not limited thereto.

In the present invention, a thickness of the base sheet may be in a range of 50 μm to 300 μm, preferably from 100 μm to 200 μm, and more preferably from 100 μm to 150 μl. If the thickness of the base sheet of the present invention is less than 50 μm, the overall stability of the heat-generating film may decrease. Further, if the thickness of the base sheet of the present invention exceeds 300 μm, physical properties such as comfort property and filling property may decrease.

However, the thickness of the base sheet is nothing but an example of the present invention. Namely, in the present invention, the thickness of the base sheet can be controlled properly in consideration of the kind of the base sheet, a structure thereof taking into consideration whether it is a monolayer or multilayer, a laminated structure, and the desired comfort property and filling property.

For example, if the said polyester film (ex. biaxially oriented polyester film) as a base sheet is used in the present invention, the thickness thereof may be set to 110 μm or less, and preferably about 100 μm in the consideration of the desired comfort property and filling property. Further, if the said laminated film of the polyester film (ex. biaxially oriented polyester film) and polyurethane film (ex. thermoplastic polyurethane film) as the base sheet is used in the present invention, the thickness of the polyester film can be set to about 60 μm or less, and preferably about 50 μm, and the thickness of the polyurethane film can be set within a range of about 50 μm to 100 μm in the consideration of the desired physical properties.

The heat-generating film (1) of the present invention comprises the heat-generating layer (12) formed at the upper part of the base film (11).

Specifically, in the heat-generating film of the present invention, the width (W of FIG. 2) of the heat-generating part may be about 5 mm to 15 mm, and preferably about 8 mm to 10 mm. Further, if the heat-generating layer comprises two or more heat-generating parts, a distance (P of FIG. 2) between each heat-generating part may be set to about 7 mm to 20 mm, and preferably about 10 mm to 15 mm. In the present invention, if the dimension of the heat-generating part is out of the range described above, the low voltage driving quality may decrease, or inducing uniform heat-generation all over the heat-generating film may be difficult.

In the present invention, in relation to low voltage driving quality of the heat-generating film and uniform heat-generating induction, the width (W) and distance (P) of the heat-generating part are proportional each other. Namely, in case that the width (W) of the heat-generating part is set relatively short in the present invention, if the distance of the heat-generating part is too far, the low voltage driving quality may decrease, or inducing uniform heat-generation in the heat-generating film may be difficult. On the other hand, in case that the width (W) of the heat-generating part is set relatively long in the present invention, if the distance of the heat-generating part is too close, the low voltage driving quality may decrease, or inducing uniform heat-generation in the heat-generating film may be difficult. Thus, in the present invention, it is preferred that the dimension of the heat-generating part is set in the consideration of the said proportion relation. For example, if the width of the heat-generating part is set to about 8 mm in the present invention, the distance (P) of the heat-generating part can be adjusted to 10 mm to 12 mm, and preferably about 10 mm; if the width (W) of the heat-generating part is set to about 9 mm, the distance (P) of the heat-generating part can be adjusted to about 10 mm to 14 mm, and preferably about 12 mm; and if the width (W) of the heat-generating part is set to about 10 mm, the distance (P) of the heat-generating part can be adjusted to about 13 mm to 15 mm, and preferably about 15 mm. However, the said example is only one embodiment of the present invention, and the dimension of the said pattern can be controlled in the present invention as long as low voltage driving quality and uniform heat-generating induction are obtained.

Further, in the heat-generating film of the present invention, a thickness of the heat-generating part may be in a range of about 1 μm to 10 μm, and preferably about 3 μm to 7 μm. If the thickness of the heat-generating part is too low in the present invention, the heat-generating efficiency may decrease. On the other hand, if the part is too thick, the mass-producibility of the heat-generating product may decrease, or the product characteristics such as the comfort property and filling property may go down.

On the other hand, a length (L of FIG. 2) of the heat-generating part is selected according to the kind of the product to which the part is applied and is not particularly limited in the heat-generating film of the present invention, for example, selected properly within a range of about 5 mm to 25 mm, and preferably about 8 mm to 15 mm.

In the present invention, a material which makes up the said heat-generating part or the heat-generating layer comprising the heat-generating part is not particularly limited. For example, the heat-generating part may include carbon nanotubes (CNTs) as the heat-generating material. Accordingly, when the CNTs are used as the heat-generating material, in comparison with the existing carbon material, problems that the heat-generating material is separated by a physical impact in use and that the resistance is changed severely can be solved, and low voltage operation can be more efficient because the amount of the heat-generating material to convert the kinetic energy of the electrons to heat energy can be small.

More specifically, the heat-generating part may comprise a binder resin and CNTs in the present invention, and the CNTs may be contained in an amount of about 3 weight parts to 15 weight parts based on the 100 weight parts of the binder resin. If the amount of the CNTs is less than 3 weight parts in the present invention, the low voltage driving quality of the heat-generating film may decrease, or the heat-generating efficiency may go down. Further, if the amount of CNTs exceeds 15 weight parts, the mass-producibility of the product or economic efficiency may decrease.

The kind of the binder resin which can be used is not particularly limited, and any resin which is conventionally used as a binder can be used. For example, acryl resin (ex. EXP-6, LG chemistry), polyester resin (EPON 828, Natrochem), PVC resin (KA-SP-2, KSA), PVAc resin (Elotex W product, National Starch) or EVA resin (Flowkit FL product, National Starch) can be used.

Further, the kinds of CNTs which can be used in the present invention are also not particularly limited, and, for example, Multi-walled CNTs (MWCNTs) can be used. CNTs have a structure wherein a graphene sheet is rolled with a nano-size diameter, and can be classified into Single-walled CNTs (SWCNTs), Double-walled CNTs (DWCNTs) and Multi-walled CNTs (MWCNTs) according to the number of layers overlapped by the rolling of the graphene sheets. In the present invention, it is preferred to use MWCNTs among the said CNTs, but not limited thereto. In the present invention, for example, carbon nanotubes having a cross section diameter of about 4 nm to 15 nm and aspect ratio of 1,200 to 20,000 can be used.

In the present invention, a method to constitute the heat-generating part comprising the said components is not particularly limited. In the present invention, for example, first of all, the binder resin and carbon nanotubes described above are dispersed in the proper solvent (ex. Ketone-based solvent such as methyl ethyl ketone (MEK), methyl isobutyl ketone (MIBK) or acetone; alcohol-based solvent such as isopropyl alcohol (IPA) or n-hexanol; 1,2-dichlorobenzene, N-methylpyrrolidone (NMP) or N,N-dimethylformamide (DMF)), and diluted to the proper concentration to prepare a coating solution. Then, the coating solution is applied by a gravure printing or silk printing method to obtain the heat-generating part or heat-generating layer.

Figure 2:
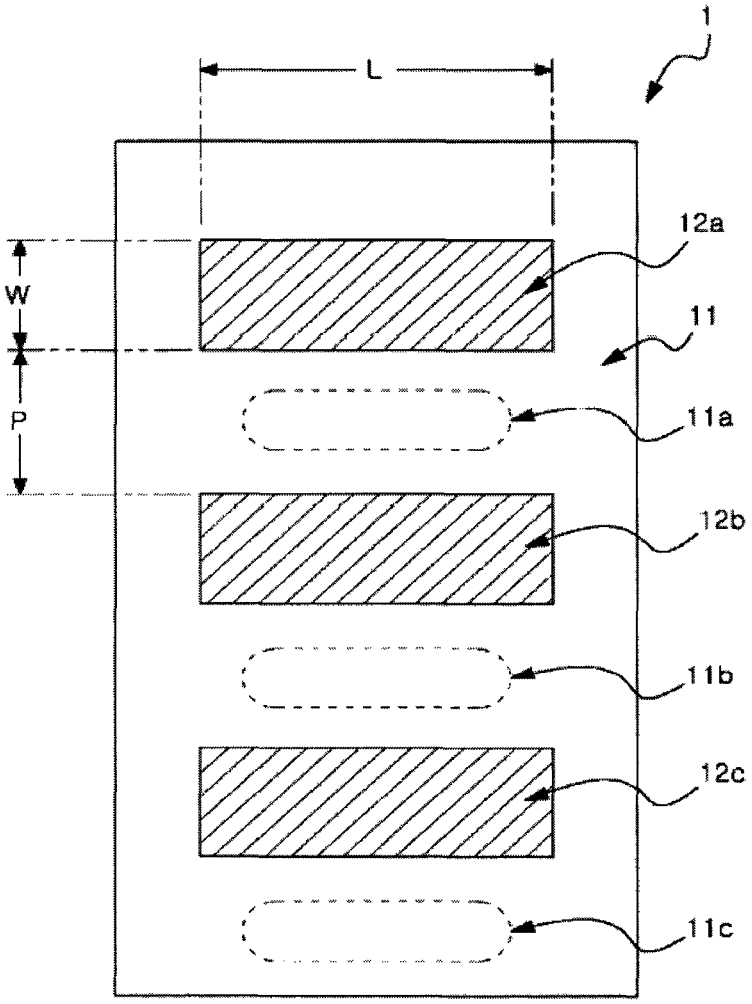
FIG. 2 is a mimetic diagram of a pattern of a heat-generating layer according to one embodiment of the present invention.

On the other hand, in the present invention, a punching hole (11*a*, 11*b*, 11*c* and the like) can be formed on the base sheet (11) between each heat-generating part (12*a*, 12*b*, 12*c* and the like) which is patterned in a linear configuration as shown in FIG. 2, and thus, the comfort property and filling property of the heat-generating film can be further enhanced.

The heat-generating film (1) of the present invention comprises an electrode layer (13) formed at the upper part of the heat-generating layer (12).

Figure 3:
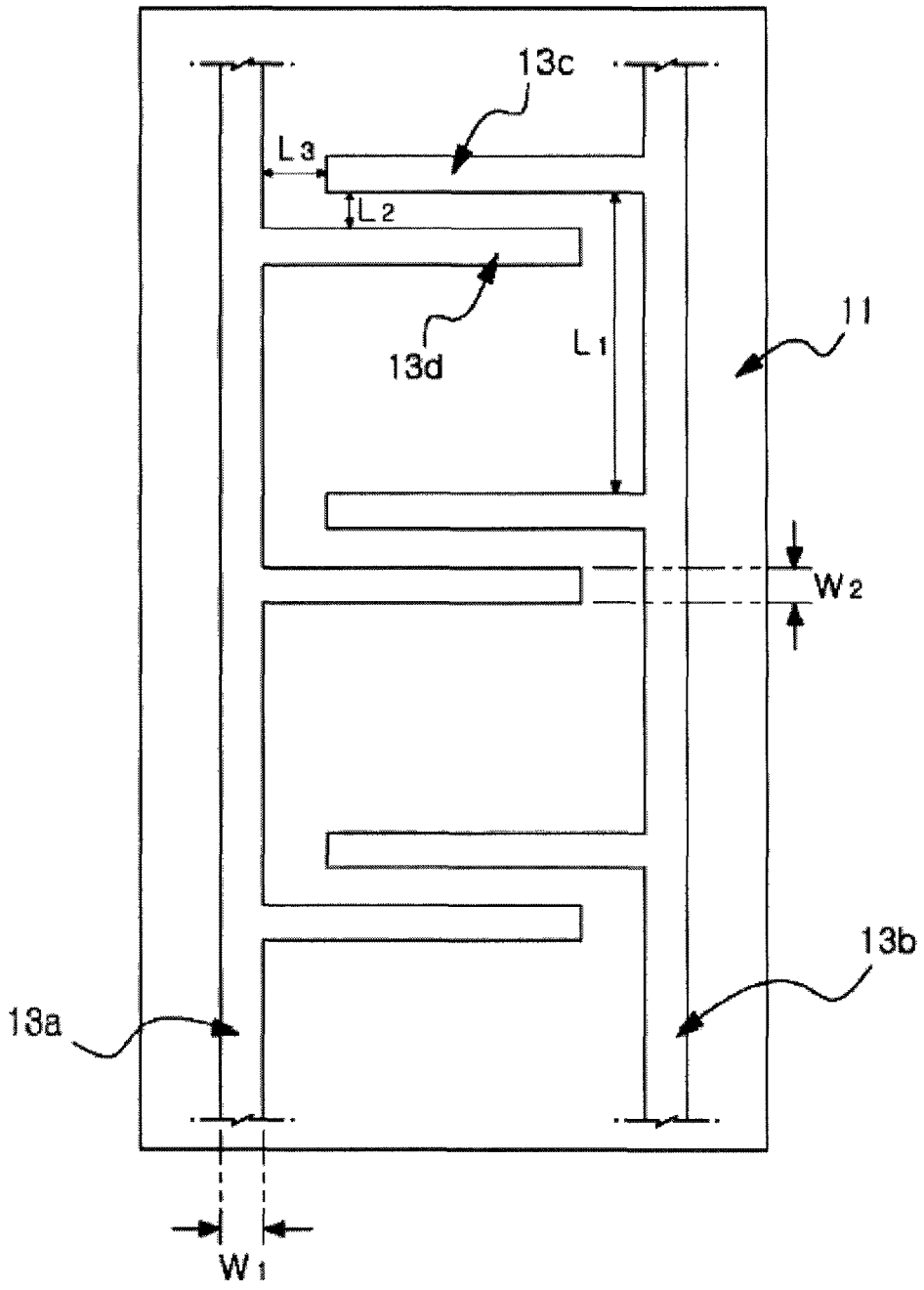
FIGS. 3 to 6 are mimetic diagrams of a pattern of an electrode layer according to one embodiment of the present invention.

In the present invention, as shown in FIG. 3 (the illustration of the heat-generating layer is omitted in FIG. 3), the electrode layer (13) may comprise a first main electrode (13*a*) and second main electrode (13*b*) which are patterned in a direction perpendicular with the direction where the heat-generating part is formed on the base sheet (11) (for example, longitudinal direction of the base sheet) and formed at the both ends of the base sheet (11), respectively; and one or more auxiliary electrodes (13*c*, 13*d*) which is extended from each main electrode (13*a*, 13*b*) in a direction parallel with the direction where the heat-generating part is formed on the base sheet (11) (for example, widthwise direction of the base sheet).

In the present invention, it is preferred to set a two point resistance of the main electrode (13*a*, 13*b*) to about 0.4 Ω/cm or less, preferably 0.2 Ω/cm or less, and to set the two point resistance of the auxiliary electrode (13*c*, 13*d*) to within a range of 0.4 Ω/cm to 0.7 Ω/cm. The term ⌈two point resistance⌋ used in the present invention refers to a resistance measured between two points with a random distance using a known two point resistor. The present invention can prevent inducing unnecessary heat-generation at the electrode layer, and control to induce uniform heat-generation all over the heat-generating film by setting the two point resistances of the main electrode and auxiliary electrode to the range described above. On the other hand, in the present invention, the operation is more efficient as the two point resistance of the main electrode (13*a*, 13*b*) is lower, and the lower limit is not particularly limited.

On the other hand, in the present invention, it is preferred to pattern the electrode layer into a designated configuration in the point of view of inducing low voltage driving quality and uniform heat-generation like the heat-generating layer.

Namely, in the present invention, a width ($W_1$) of the main electrode (13*a*, 13*b*) can be set to a range of about 8 mm to 30 mm, preferably from 8 mm to 12 mm, and more preferably from 9 mm to 11 mm. In the present invention, if the width ($W_1$) of the main electrode (13*a*, 13*b*) is less than 8 mm, unnecessary heat-generation may be induced at the electrode part by over increasing the two point resistance of the main electrode, and if the width exceeds 30 mm, a resistance deviation may occur by the occurrence of a thickness deviation of the electrode layer.

Further, in the present invention, a thickness of the main electrode (13*a*, 13*b*) can be set to a range of about 5 μm to 25 μm, and preferably from 6 μm to 10 μm. In the present invention, the thickness of the main electrode (13*a*, 13*b*) is less than 5 μm, unnecessary heat-generation may be induced at the electrode part by over increasing the two point resistance of the main electrode, and if the thickness exceeds 25 μm, it may cause cracks and a resistance deviation at the cracked regions by the occurrence of a thickness deviation of the electrode layer when it is applied to a product requiring a flexibility.

On the other hand, in the present invention, the auxiliary electrode (13*c*, 13*d*) extended from the main electrode (13*a*, 13*b*) can also be formed into a designated pattern. For example, in the present invention, a distance ($L_1$) between the plural auxiliary electrodes extended from one main electrode (ex. The first or second main electrode) can be in a range of about 5 mm to 30 mm, and preferably from about 16 mm to 26 mm.

Further, in the present invention, it is preferred to closely arrange the auxiliary electrode (13*d*) extended from the first main electrode (13*a*) and the auxiliary electrode (13*c*) extended from the second main electrode (13*b*) with a fixed distance ($L_2$ of FIG. 3). In this case, the distance ($L_2$) between the auxiliary electrodes arranged separately may be about 4 mm or less, preferably. If the distance ($L_2$) between the auxiliary electrodes exceeds 4 mm, the electric current may not flow smoothly. On the other hand, the lower limit of the distance ($L_2$) between the auxiliary electrodes is not particularly limited in the present invention, and for example, the distance can be controlled properly in a range of more than 0 mm.

Further, in the present invention, it is preferred to separately arrange the auxiliary electrode and the opposing main electrode thereto, namely, the main electrode which is across from the main electrode where the auxiliary electrode is extended from (for example, in FIG. 3, the opposing main electrode to the auxiliary electrode (13*c*) is the main electrode (13*a*), and the opposing main electrode to the auxiliary electrode (13*d*) is the main electrode (13*b*)) with a fixed distance ($L_3$ of FIG. 3). In the present invention, for example, the distance ($L_3$) can be controlled properly to be within a range of more than 0 mm and less than 4 mm in the point of view of smooth flow of electric current.

In the present invention, further, a width ($W_2$) of the auxiliary electrode may be 0.5 mm or more, preferably 1 mm and more. If the width ($W_2$) of the auxiliary electrode is less than 0.5 mm which is within the margins of error of electrode printing, the fluidity of the electric current may be changed or the heat-generating efficiency may decrease by the occurrence of non-uniform printing. On the other hand, in the present invention, the upper limit of the width ($W_2$) is not particularly limited, and, for example, it can be controlled properly to be within a range of 3 mm or less.

Figure 4:
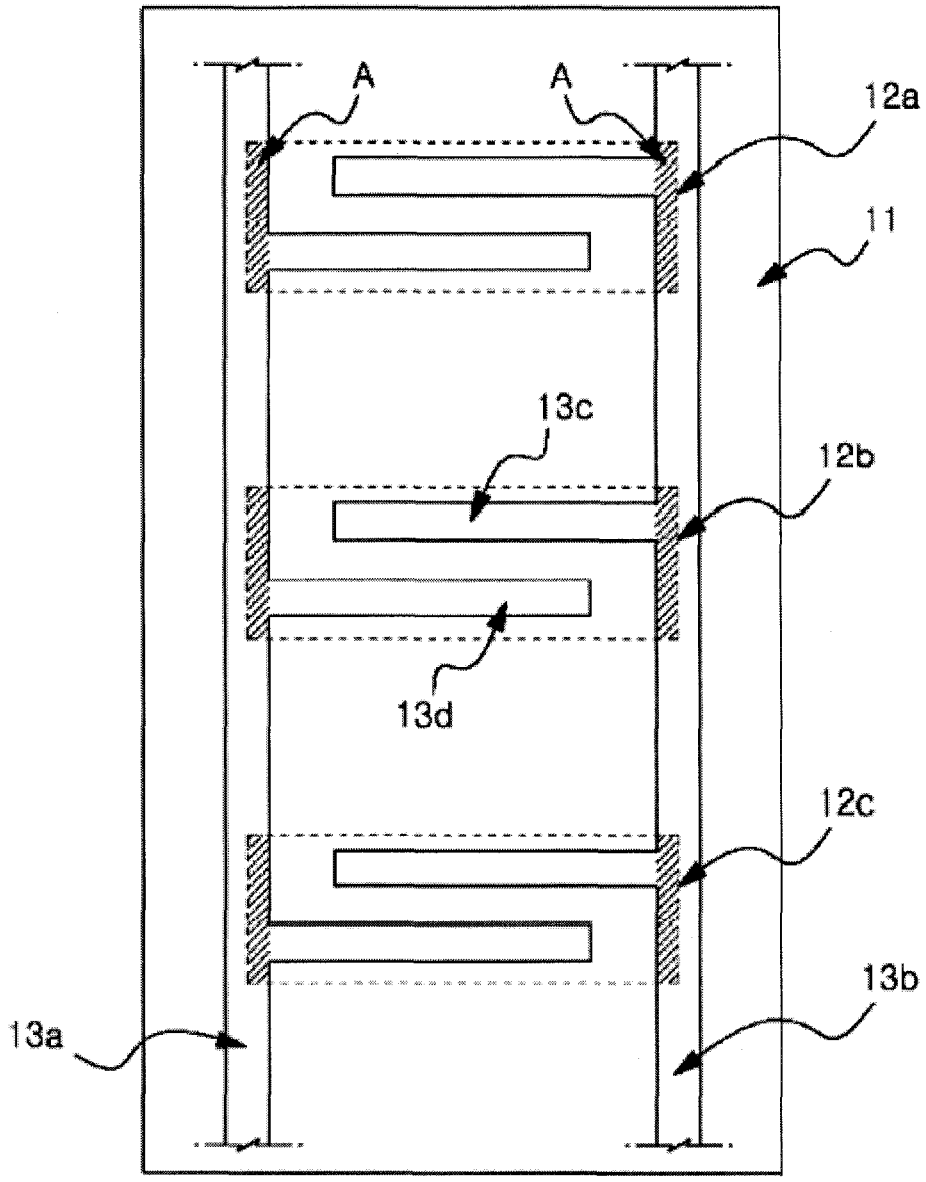

As shown in FIG. 4, in the heat-generating film of the present invention, the main electrodes (13*a*, 13*b*) of the patterned electrode layer are contacted with both ends of the heat-generating part (12*a*, 12*b*, 12*c*) at designated regions (A), and the auxiliary electrode (13*c*, 13*d*) can exist in formed state on the heat-generating part (12*a*, 12*b*, 12*c*). In the above, the area of the region (A) where the heat-generating part (12*a*, 12*b*, 12*c*) and main electrodes (13*a*, 13*b*) are contacted is not particularly limited, and can be controlled properly according to the application.

In the present invention, further, the first or second main electrode can have a double arrangement structure.

Figure 5:
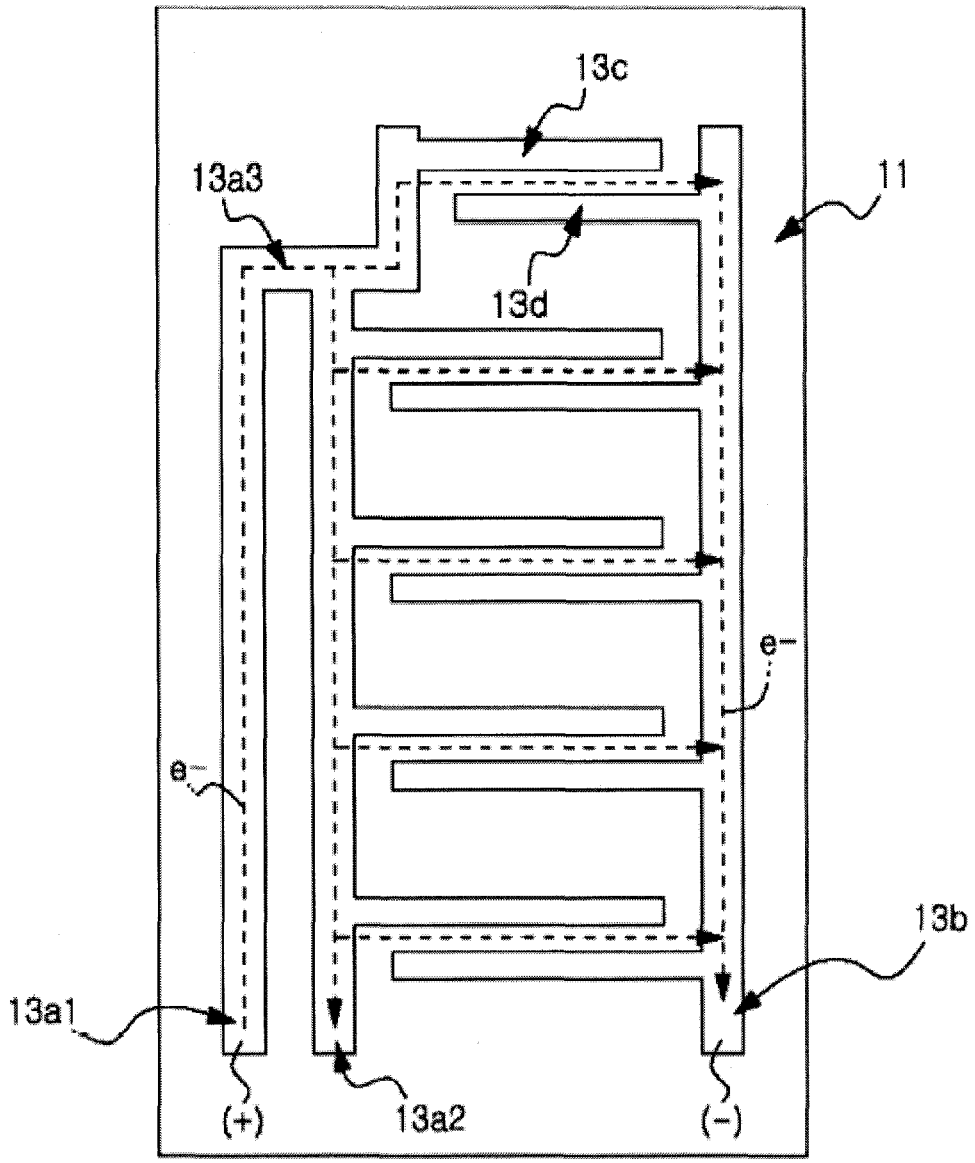

For a specific example, in the present invention, as shown in FIG. 5, one of the two main electrodes, for example, the first main electrode may comprise a first vertical part (13*a*1) which is formed in a direction perpendicular with the heat-generating part on the base sheet (11); a second vertical part (13*a*2) which is separated parallelly by a fixed distance and formed in the internal direction of the base sheet (11); and a horizontal part (13*a*3) connecting the ends of the first and second vertical parts (13*a*1, 13*a*2).

In the above, widths of the first vertical part (13*a*1), the second vertical part (13*a*2) and the horizontal part (13*a*3), for example, can be controlled by the same method used for the main electrode of the heat-generating film. Namely, in the present invention, each width of the first vertical part (13*a*1), the second vertical part (13*a*2) and the horizontal part (13*a*3) can be 8 mm to 30 mm, respectively, or the width of the entire part which includes the first vertical part (13*a*1) and the second vertical part (13*a*2) (i.e., the width of the first vertical part+the width of the second vertical part+the distance between the first and second vertical parts) can be selected from a range of 8 mm to 30 mm. Further, the separation distance between the first vertical part (13*a*1) and the second vertical part (13*a*2) is not particularly limited, and, for example, can be selected properly in the consideration of the heat-generating efficiency of the heat-generating film. In the present invention, for example, the distance between the first vertical part (13*a*1) and the second vertical part (13*a*2) can be controlled properly to be within a range of 10 mm to 15 mm. Further, in the electrode pattern shown in FIG. 5, the thickness of the main electrode and the like, the pattern and dimension of the auxiliary electrode extended from the main electrode and the like are not particularly limited, and, for example, the same description with the case of the said FIG. 3 can be applied.

In the present invention, the electrode layer, specifically, any one of the main electrodes is constituted in a double arrangement like above to obtain an effect that the voltage is applied in the diagonal direction even when the voltage application apparatus is connected to the same direction in the two main electrodes. Thus, uniform heat-generation can be induced all over the heat-generating film even when the resistance exists at the electrode layer.

These effects will be described in detail as follows by referring to the attached FIGS.

Figure 6:
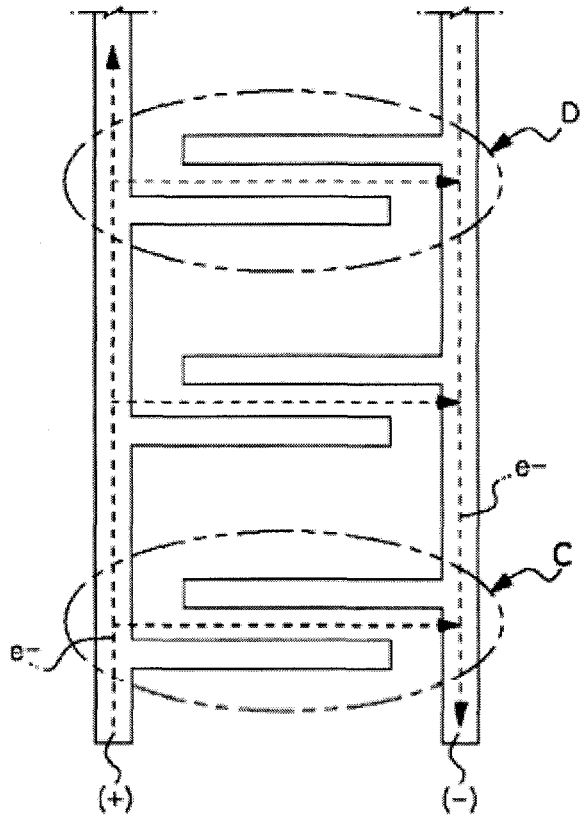

The attached FIG. 6 is a diagram representing the case that the main electrodes of both sides are formed as single structures. As shown in FIG. 6, when the main electrodes are formed in the single structures, and the voltages are applied to the each lower part of the main electrodes, the electrons move in the same direction as the case of the dotted line shown in the diagram. Namely, the electrons move to the upper part along the main electrode wherein the (+) voltage is applied to the lower part thereof, and then the moving electrons move to the other side of the main electrode wherein the (−) voltage is applied to the lower part thereof along the auxiliary electrode which is formed on each spot of the main electrode followed by moving to the lower part.

In this way, because each material (ex. silver) making up the main electrode and auxiliary electrode also has a self resistance of a certain range, for example, energy from electrons moving to the upper part along the (+) voltage applied main electrode, the energy from the electrons moving to the lower part along the (−) voltage applied main electrode and the energy from the electrons moving in the parallel direction along the auxiliary electrode is converted to heat energy while moving through the resistance, and then dissipates. Therefore, in the constitution shown in FIG. 6, the amount of the electrons moving in the upper part (D) becomes small in comparison with the lower part (C) of the entire electrode layer, and thus, a temperature deviation may be induced according to the difference of the heat-generating efficiency between the upper and lower parts of the heat-generating film.

As a method to minimize the said problems, a method to intercross the directions of the applied voltage, wherein the electrons move diagonally by applying (+) voltage to the lower part of one main electrode and (−) voltage to the upper part of the other main electrode can be considered. However, the said method for applying the voltage may be impossible according to the application of the heat-generating film. For example, when the heat-generating film of the present invention is applied to the vehicle sheet, in the scheme of the product, the direction of the applied voltage is limited to one direction as shown in FIG. 6.

However, if the electrode is constituted like the present invention, the voltage can be applied in a diagonal direction although the direction of the applied voltage is limited. Accordingly, uniform heat-generation can be induced all over the heat-generating film without any loss of the energy of the electrons caused by the self resistance of the electrode.

For example, as shown in FIG. 5, in a pattern of the electrode comprising the main electrode having a double arrangement, if the (+) voltage is applied at the lower part of the first vertical part (13*a*1) of the main electrode having the double arrangement, and the (−) voltage is applied at the lower part of the other side of the main electrode (13*b*), the electrons move to the upper direction along the first vertical part (13*a*1) and then move to the lower direction along the second vertical part (13*a*2) via the horizontal part (13*a*3). Namely, according to the said constitution, the electrons move in the same direction at the second vertical part (13*a*2) and other side of the main electrode (13*b*), and thus the temperature deviation is not induced at each spot of the heat-generating film, and uniform heat can be generated all over.

In the present invention, a material making up the said electrode layer is not particularly limited. For example, the electrode layer of the present invention may be a silver (Ag) electrode layer.

Further, in the present invention, a method for constituting the said silver electrode layer is not particularly limited. For example, first of all, conventional silver nanoparticles used for preparing the electrode are dispersed in a proper solvent (ex. Ketone-based solvent such as methyl ethyl ketone (MEK), methyl isobutyl ketone (MIBK) or acetone; alcohol-based solvent such as isopropyl alcohol (IPA) or n-hexanol; 1,2-dichlorobenzene, N-methylpyrrolidone (NMP) or N,N-dimethylformamide (DMF)), and diluted to the proper concentration to prepare a coating solution (concentration of the silver nanoparticles is about 55 weight % to 72 weight %). Then, the coating solution is applied by a gravure printing or silk printing method to obtain the electrode layer.

Figure 7:
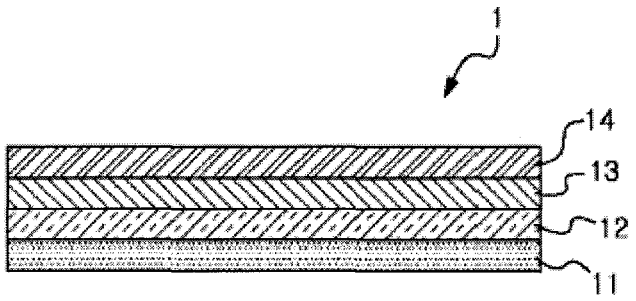
FIGS. 7 to 9 are mimetic diagrams of cross sections of heat-generating films according to various embodiments of the present invention.

In addition, the heat-generating film of the present invention may further comprise a protection layer (14) formed at the upper part of the electrode layer (13) as shown in FIG. 7. Thus, the protection layer (14) formed additionally can prevent the adhesive force between the heat-generating layer (12) and electrode layer (13) decreasing due to the long-term use, or the heat-generating film performance is diminished by the desorption of the heat-generating material contained in the heat-generating layer (12).

In the present invention, a material making up the said protection layer (14) is not particularly limited, and, for example, the protection layer (14) may comprise a synthetic resin film; and an adhesive layer formed on one or both sides of the synthetic resin film. In the above, the kind of the synthetic resin film which can be used is not particularly limited, and, for example, the same film with the synthetic resin film making up the base sheet described above, preferably a biaxially oriented polyester film can be used, but not limited thereto.

Further, the kind of the adhesive layer which is formed on one or both sides of the synthetic resin film is not particularly limited, and a conventional acryl-based adhesive, EVA-based adhesive or polyvinyl alcohol-based adhesive can be used.

Further, a thickness of the protection layer (14) can be selected properly in the consideration to the application, and, for example, the thickness of the synthetic resin film can be set to about 20 μm to 30 μm, preferably about 25 μm, and the thickness of the adhesive layer can be set to about 20 μm to 80 μm, about 25 μm to 75 μm, or about 25 μm to 50 μm, but not limited thereto.

Figure 8:
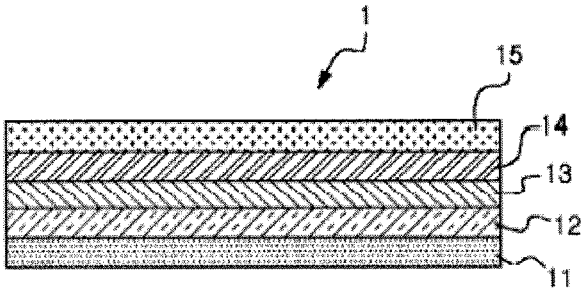

In addition, the heat-generating film of the present invention may further comprise a surface layer formed at the upper part of the electrode layer. This surface layer may be formed at the upper part of the said protection layer (14) as shown in attached FIG. 8. By comprising the surface layer (15), the configuration stability of the sheet can be obtained, and damage such as tear can be prevented.

In the present invention, the kind of the surface layer is not particularly limited, and, for example, general woven fabric or non-woven fabric, preferably woven fabric can be used.

In the present invention, examples of the woven fabric or non-woven fabric may include a woven fabric or non-woven fabric which is prepared with one or more synthetic resin fibers selected from a polyester fiber, polyamide fiber, polyurethane fiber, acryl fiber, polyolefin fiber or cellulose fiber; woven fabric or non-woven fabric which is prepared with a cotton (ex. A thread prepared with cotton cloth); or woven fabric or non-woven fabric which is prepared by mixing the synthetic resin fiber and cotton. It is preferred to use polyester fiber; or woven fabric prepared with the polyester fiber and cotton among the said examples in the present invention, but not limited thereto. Further, a method of preparing the woven fabric or non-woven fabric using the said materials is not particularly limited, and, for example, the fabric can be prepared by a general paper-making or weaving process.

In the present invention, a thickness of the said surface layer may be in a range of 200 μm to 2,000 μm. If the thickness of the surface layer is less than 200 μm in the present invention, the reinforcement effect such as the configuration stability by forming the surface layer may be slight, and if the thickness exceeds 2,000 μm, the characteristics of the heat-generating film such as the comfort property or filling property may decrease.

Figure 9:
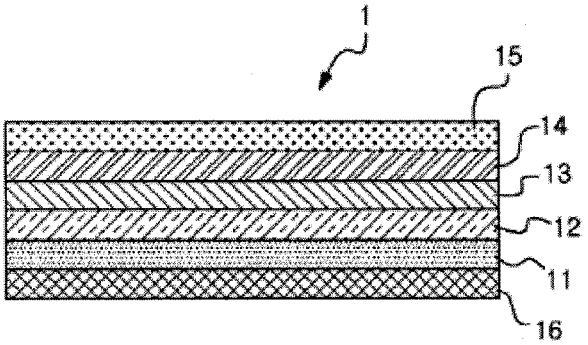

In addition, the heat-generating film of the present invention may further comprise an inside layer (16) which is formed at the lower part of the base sheet (11) as shown in attached FIG. 9, and the configuration stability of the sheet can be more improved by forming the inside layer (16). In the present invention, a material making up the said inside layer (16) is not particularly limited, and, for example, the same material with the case of the surface layer (15) described above can be used.

Further, the present invention relates to a heat-generating product comprising the heat-generating film described above; and a voltage application apparatus which can apply the voltage to the heat-generating film.

This heat-generating product of the present invention may be, for example, a vehicle heat-generating sheet, stroller heat-generating sheet, portable cushion, portable mat, clothing (ex. jumper, coat, parka and the like), portable chair or portable bed and the like.

As described above, the heat-generating film according to the present invention can generate heat continuously and stably even at a low voltage, for example, about 12 V, and exhibits good comfort and filling property by having excellent flexibility, as well as various properties such as fire retardancy and corrosion resistance. Therefore, the heat-generating film of the present invention can be applied to the various heat-generating products as described above and can exhibit excellent effects.

While using the heat-generating film according to the present invention, other constitutions of the said heat-generating product of the present invention, for example, the voltage application apparatus, main body of the vehicle sheet and method for constructing the sheet are not particularly limited, and the conventional materials and method which are known in the art can be applied without limitation.

EXAMPLE

Hereinafter, the following examples are provided to further illustrate the invention, but they should not be considered as the limit of the invention.

Example 1

100 weight parts of an acryl resin (EXP-6, LG chemistry) and about 10 weight parts of MWCNT (EXA E&C Inc.) were dispersed in a solvent (isopropyl alcohol) to prepare a coating solution for forming a heat-generating part. Then, the prepared coating solution was applied by a gravure printing method to form a patterned heat-generating part on a biaxially oriented polyester film (BOPET) having a thickness of 100 μm, horizontal length of 800 mm and vertical length of 600 mm as shown in FIG. 2. At this time, a thickness of each heat-generating part was controlled to be about 5 μm, and a width (W) and distance (P) thereof were set to 8 mm and 10 mm, respectively. Then, silver nanoparticles (Ag Paste for a low temperature electrode, EXA E&C Inc.) were dispersed in a solvent (IPA) to prepare a coating solution (silver nanoparticle concentration: about 56 wt %), and the coating solution was applied by a gravure printing method to form an electrode layer as shown in FIGS. 3 and 4 to output 27 Watt (DC 12 Volt) on the heat-generating part. At this time, a width ($W_2$) of an auxiliary electrode, width ($W_1$) of a main electrode, distance ($L_2$) between the auxiliary electrodes, distance ($L_3$) between the auxiliary electrode and the main electrode and distance ($L_1$) between the auxiliary electrodes were controlled to be 4 mm, 8 mm, 4 mm, 4 mm and about 15 mm, respectively.

Example 2

The procedure of Example 1 was repeated except for setting the width (W) to 9 mm and distance (D) to 10 mm when the pattern of the heat-generating part was formed to prepare the heat-generating film.

Example 3

The procedure of Example 1 was repeated except for setting the width (W) to 9 mm and distance (D) to 12.5 mm when the pattern of the heat-generating part was formed to prepare the heat-generating film.

Example 4

The procedure of Example 1 was repeated except for setting the width (W) to 10 mm and distance (D) to 12.5 mm when the pattern of the heat-generating part was formed to prepare the heat-generating film.

Example 5

The procedure of Example 1 was repeated except for setting the width (W) to 10 mm and distance (D) to 15 mm when the pattern of the heat-generating part was formed to prepare the heat-generating film.

Comparative Example 1

As a planar heat-generator, the existing wire type product used generally was prepared and used as a Comparative Example. Specifically, it was a heat-generating product (27 Watt (DC12 Volt) (88190-2H100, Kwangjin Wintec) prepared by attaching Ni—Cr wire which has a thickness of 1 mm to a cross section of a non-woven fabric (100 g) which has a horizontal length of 800 mm and vertical length of 600 mm with a gap of 30 mm by using a hot-melt adhesive.

Test Example 1

Figure 10:
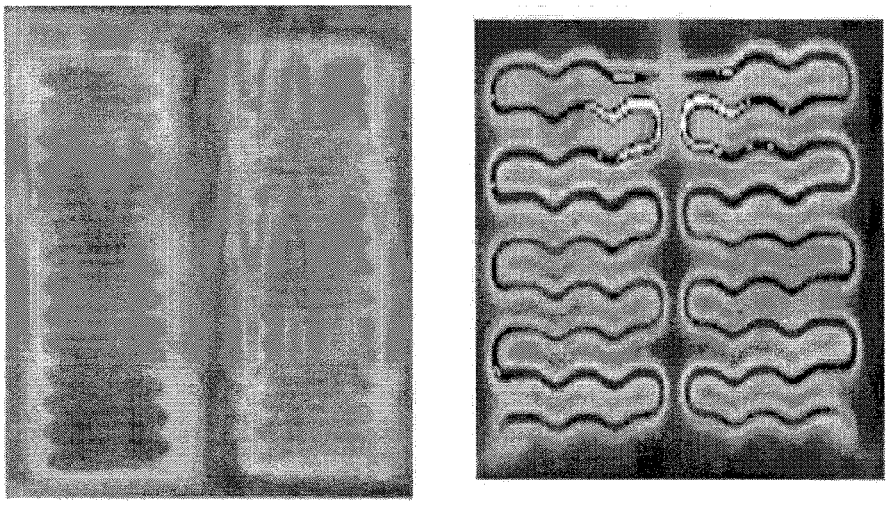
FIG. 10 is images taken by an infrared camera to measure whether the heat-generating sheets of Examples and Comparative Example generate heat in a Test Example of the present invention.

A 12V voltage was applied to the heat-generating film of Example 1 and Comparative Example 1, and whether heat was generated uniformly all over the film was observed through an infrared camera (IR Flexcam Pro, Infrared Solution), then the result was shown in FIG. 10. As shown in FIG. 10, in case of Example (FIG. 10(*a*)) according to the present invention, a stable operation is possible at a low voltage of 12V, and heat-generation is induced uniformly all over the sheet. Whereas, in case of the existing wire type heat-generating film of Comparative Example 1 (FIG. 10(*b*)), the operation was not conducted efficiently at low voltage, and the heat-generation was conducted non-uniformly all over the sheet. In other hand, in cases of Examples 2 to 5, stable operation was possible at a low voltage like Example 1, and the heat-generation was conducted uniformly all over the sheet.

The heat-generating film of the present invention can continuously and stably generate heat even at a low voltage, for example, at a voltage of 12V or lower. In addition, the heat-generating film of the present invention has excellent comfort properties, filling properties and flexibility. Accordingly, the heat-generating film of the present invention can be applied to a variety of heat-generating products, for example a heat-generating sheet for a vehicle or baby stroller, or to a variety of portable heat-generating products and the like, and exhibits superior effects.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A heat-generating film comprising:

a base sheet;

a heat-generating layer which is formed on the base sheet and has two or more separated heat-generating parts patterned parallel to each other in a first linear configuration such that two opposing edges of each heat-generating part are aligned with two opposing edges of each other heat generating part; and an electrode layer comprising a first main electrode and a second main electrode which are patterned on the base sheet;

wherein the first main electrode comprises:

a first vertical part, to which (+) voltage is applied at the lower part, the first vertical part formed in a direction perpendicular with the heat-generating part;

a second vertical part separated parallel to the first vertical part and formed in an internal direction of the base sheet; and a horizontal part connecting an end of the first vertical part to an end of the second vertical part;

wherein the second main electrode, to which (−) voltage is applied at the lower part, does not comprise a horizontal part connecting an end of a first vertical part to an end of a second vertical part;

the first vertical part and the second vertical part of the first main electrode and the second main electrode are patterned in a second linear configuration parallel to each other and perpendicular to each heat-generating part having the first linear configuration and the first main electrode and the second main electrode are formed at each of two opposing ends of the base sheet, respectively, and the electrode layer further comprises one or more auxiliary electrodes which are extended from each of the second vertical part of the first main electrode and the second main electrodes in a direction parallel with each heat-generating part, wherein a two point resistance of the first and second main electrodes is 0.2 Ω/cm or less, wherein a two point resistance of the auxiliary electrodes is 0.4 Ω/cm to 0.7 Ω/cm, wherein the pattern of the electrode layer is configured by a respective width and thickness, and spacing between each of the electrodes, wherein the width of the first and second main electrodes is 8 mm to 30 mm, wherein the heat-generating part has a width of 5 mm to 15 mm, wherein a thickness of the first and second main electrodes is 5 μm to 25 μm, wherein a distance between the auxiliary electrodes extended from the first main electrode or second main electrode is 5 mm to 30 mm, wherein the auxiliary electrode extended from the first main electrode and the auxiliary electrode extended from the second main electrode are separately arranged with a distance of 4 mm or less, wherein a width of the auxiliary electrode is 0.5 mm to 1 mm, wherein a distance between the auxiliary electrode extended from the first main electrode and the second main electrode; or a distance between the auxiliary electrode extended from the second main electrode and the first main electrode is more than 0 mm and less than 4 mm, wherein a distance between each heat-generating part is between 7 mm and 20 mm, wherein a width of each heat generating part and the distance between adjacent heat-generating parts are proportional to each other, wherein a thickness of the heat-generating part is in a range of 1 μm to 10 μm, wherein a voltage application apparatus which applies a voltage to the electrode layer of the heat-generating film in a diagonal direction even when the voltage application apparatus is connected in the same direction as the first main electrode and second main electrode, and wherein the heat-generating part comprises a binder resin and carbon nanotubes, wherein the carbon nanotubes comprise an amount of about 3-15 weight parts based on 100 weight parts of the binder resin.

2. the heat-generating film of claim 1, wherein the heat-generating part further comprises multi-walled carbon nanotubes.

3. The heat-generating film of claim 1, wherein a punching hole is formed on the base film between the heat-generating parts.

4. The heat-generating film of claim 1, wherein the first and second main electrodes are contacted with the heat-generating part, and the auxiliary electrode is formed on the upper part of the heat-generating part.

5. The heat-generating film of claim 1, wherein the main electrode and auxiliary electrode comprise silver.

6. The heat-generating film of claim 1, which further comprises a protection layer formed on the upper part of the electrode layer.

7. The heat-generating film of claim 1, which further comprises a surface layer formed on the upper part of the electrode layer.

8. The heat-generating film of claim 1, wherein the binder resin is selected from the group consisting of acryl resin, polyester resin, PVC resin, PVAc resin, and EVA resin.

* * * * *